US005189395A

United States Patent [19]

Mitchell

[11] Patent Number: 5,189,395

[45] Date of Patent: Feb. 23, 1993

[54] ELECTRONIC HOUSE ARREST SYSTEM HAVING OFFICER SAFETY REPORTING FEATURE

[75] Inventor: Michael S. Mitchell, Phoenix, Ariz.

[73] Assignee: BI, Inc., Boulder, Colo.

[21] Appl. No.: 698,691

[22] Filed: May 10, 1991

[51] Int. Cl.[5] ..... G08B 1/08

[52] U.S. Cl. ..... 340/539; 340/531; 340/572; 340/573; 379/38

[58] Field of Search ..... 340/539, 531, 572, 573; 379/37-39, 42-44, 33, 34; 455/100, 101, 67, 95, 115

[56] References Cited

U.S. PATENT DOCUMENTS

| | | | |
|---|---|---|---|
| 3,925,763 | 12/1975 | Wadhwani et al. | 340/539 |
| 4,734,680 | 3/1988 | Gehman et al. | 340/531 |
| 4,747,120 | 5/1988 | Foley | 379/38 |
| 4,777,477 | 10/1988 | Watson | 340/573 |
| 4,843,377 | 6/1989 | Fuller et al. | 340/573 |
| 4,918,432 | 4/1990 | Pauley et al. | 340/573 |
| 4,924,211 | 5/1990 | Davies | 340/573 |
| 4,952,928 | 8/1990 | Carroll et al. | 340/825.54 |

*Primary Examiner*—Donnie L. Crosland
*Attorney, Agent, or Firm*—Fitch, Even, Tabin & Flannery

[57] ABSTRACT

An electronic house arrest monitoring (EHAM) system allows a monitoring officer, charged with the responsibility of making periodic and/or random physical checks with individuals whose presence at specific locations is being electronically monitored through the EHAM system, to immediately and silently report to a central monitoring location that backup help or assistance is needed at the monitoring location. The EHAM system includes an in-house monitoring unit (IMU) installed at or positioned near specific monitoring locations, that electronically monitors the specific monitoring location for the presence of a unique identifying signal, periodically transmitted from an electronic tag worn by a monitored individual. Telecommunicative contact is periodically and/or randomly established between the central monitoring location and the IMU. The monitoring office carries a small pocket transmitter. If the officer senses danger or otherwise needs backup assistance at or near a monitored location, the office siliently activates a transmit switch on the pocket transmitter that causes a "needs assistance" signal to be transmitted. The "needs assistance" signal is received by the IMU and immediately relayed, along with address-identifying data, to the central monitoring location. A "needs assistance" signal received at the central monitoring location causes immediate help or assistance to be dispatched to the indicated address.

19 Claims, 3 Drawing Sheets

ELECTRONIC HOUSE ARREST SYSTEM HAVING OFFICER SAFETY REPORTING FEATURE

BACKGROUND OF THE INVENTION

The present invention relates to a personnel monitoring system, and more particularly to a house arrest monitoring system wherein individuals who wear a special tag can be electronically monitored for compliance with a court-ordered sentence (or similar restriction) requiring them to remain at a specified location(s) at a specified time(s). Even more particularly, the present invention relates to such an electronic house arrest system wherein a monitoring officer, e.g., a probation or parole officer responsible for making periodic and/or random physical checks with the individuals being monitored at or near the specified monitoring location(s), can immediately and silently report to a central monitoring location that backup help or assistance is needed at such location.

Electronic house arrest monitoring (EHAM) systems are known in the art. Such systems fulfill a valuable need in that they allow a relatively large number of individuals who have been ordered by a court to remain under house arrest, or who are under parole or probation requirements to remain at certain locations at specified times, to be electronically monitored for compliance with whatever restrictions have been imposed. Such electronic monitoring can advantageously be carried out at a fraction of the cost of incarceration of the monitored individuals; and also at a much reduced cost over conventional probation/parole monitoring procedures. Further, an electronic monitoring system offers the advantage of reducing the physical contact between a monitoring officer, e.g., a probation or parole officer, and the monitored individual, which physical contact can, at certain times and certain locations, pose a potential danger to the officer.

One type of house arrest monitoring system known in the art, referred to as an "active" monitoring system, generates and transmits radio wave signals as part of the monitoring process. Such an active EHAM system is described, e.g., in U.S. Pat. No. 4,918,432, issued to Pauley et al. In the Pauley et al. active EHAM system, each individual being monitored is fitted with an electronic bracelet or anklet. Such bracelet or anklet, referred to in the referenced patent as a "tag", includes a transmitter that periodically transmits a identifying radio wave signal (unique to each tag, and hence to each individual) over a short range (e.g., 150 feet). A field monitoring device (FMD) is installed at each location where the monitored individual(s) is supposed to be. If the monitored individual(s) is present at the FMD location, a receiver circuit within the FMD receives the unique identifying signal. The FMD processing circuits can thus determine that a specific individual is present at the location of the FMD when the signal is received. This information (which may be considered as "presence data") is stored within the FMD memory circuits for subsequent downloading to a central monitoring location. A computer, or central processing unit (CPU), located at the central monitoring location periodically or randomly polls the various FMD locations through an established telecommunicative link, e.g., through standard telephone lines, in order to prepare reports indicating the presence or absence of the individuals at the specified locations. Such reports are then used by the agency charged with the responsibility for monitoring the individuals to ascertain whether or not such the monitored individuals are in compliance with whatever restrictions have been imposed.

An important feature of the Pauley et al. EHAM system is the ability of the tag to detect any attempts to tamper with it, e.g., to remove the tag from the monitored individual. If a tamper event is detected, such occurrence is immediately signaled to the FMD, and the FMD, in turn, includes the ability to immediately establish telecommunicative contact with the central CPU in order to report such tamper event. All data sent from the FMD to the central CPU includes address-identifying data that identifies the specific location where the FMD is located. The '432 Pauley et al. patent is incorporated herein by reference.

Other active EHAM systems known in the art also include the ability to detect tamper events, such as U.S. Pat. No. 4,777,477, issued to Watson, wherein any attempt to cut or break the strap that attaches the tag to the individual is detected and signaled to a local receiver. The '477 Watson patent is also incorporated herein by reference.

Still other active EHAM systems known in the art include the ability to adaptively change the monitoring configuration to best suit the needs of the agency responsible for carrying out the monitoring function. See U.S. Pat. No. 4,952,928 issued to Carroll et al., which patent is likewise incorporated herein by reference. The Carroll et al. system advantageously includes the ability to sense and monitor various physiological data of the monitored individual, such as heart rate, blood pressure, body position (horizontal or vertical), and the like, so that such data can be analyzed at the central monitoring location to determine if the monitored individual is complying with other restrictions, such as abstinence from drugs or alcohol.

Another type of electronic house arrest system known in the art is a "passive" monitoring system. A passive system typically does not involve the generation and transmission of radio wave signals, such as are used in the active EHAM systems. An example of a passive system is disclosed in U.S. Pat. No. 4,747,120, issued to Foley. In the Foley system, a central computer randomly establishes telephonic contact with a specific location whereat the monitored individual is supposed to be at a time when such individual is supposed to be there. The computer then instructs the individual, e.g., using synthetically generated speech, to perform some act, such as inserting a specially coded wristlet permanently affixed to the individual (and hence unique to the individual) into a decoding device interconnected with a telephone at the remote location. If the individual successfully completes the act, which act is designed to be something that only the correct individual can successfully do, then a verify signal is sent back to the central computer over the telephone lines and the computer thus determines that the correct individual is at the remote location. If the verify signal is not received, then the computer determines that the correct individual is not at the specified location.

Another type of passive EHAM system known in the art includes the ability to also test the monitored individual for compliance with other restrictions, in addition to staying at a specified location, such as abstinence from alcohol and drugs. See, e.g, U.S. Pat. No. 4,843,377, issued to Fuller et al. In such systems, a breathalyzer device is coupled to the telephone line. If the blood alcohol level of the monitored individual exceeds prescribed limits, then an appropriate signal indicating this fact is sent to the central monitoring location. One embodiment of the system disclosed in the Fuller et al. patent includes the use of a camera at the remote location. The picture of the monitored individual is converted to electronic data and transmitted to the central location, i.e., over the telephone lines, where it is reconstructed so that the image of the monitored individual can also be checked.

Regardless of the type of EHAM system employed, whether passive, active, or combinations of active and passive, there frequently arises a need for a monitoring officer, or other individual from the monitoring agency, to physically go to the monitoring location and verify that the monitored individual is in fact at the monitored location, and that other restrictions that may have been imposed are being complied with. At other times, visits must be made to the field to check out the operation of the monitoring equipment. When this need arises, the monitoring officer, in going to the monitored location, may place himself or herself in danger of bodily harm, either directly from the monitored individual (who may be drunk, or under the influence of drugs), or from other individuals in the same neighborhood as the monitored individual. What is needed, therefore, is an EHAM system that provides the monitoring officer some measure of security and protection as such field visits are made.

One technique known in the art for providing officer safety is to require that a team of officers, e.g, at least two officers, perform the actual visit to the monitoring location. The team of officers can then use established procedures commonly practiced by law enforcement agencies to assure the safety of the officers involved, including carrying firearms and other weapons. Unfortunately, many monitoring agencies do not have the budget nor the manpower to dispatch a team of officers to a specified location to follow up on compliance with mandated restrictions. Further, a team of officers may intimidate the monitored individual, particularly if they are carrying firearms, and prevent the free flow of information that the monitoring officer may need. Hence, what is needed is an EHAM system that does not require a team of monitoring officers to check up on compliance with mandated restrictions, and that facilitates a single officer making such visits. However, should a dangerous situation develop, there is also a need for an EHAM system that allows an appropriate team of law enforcement officers, e.g., police or sheriff officers from the closest station, to be immediately dispatched to the location where the dangerous situation exists.

Another technique used in the art to provide a measure of safety for the monitoring officer is to require the monitored individual to step outside, e.g., on the front porch or otherwise in front of the monitored location, so that the monitoring officer can readily see, and even talk with, the individual from the relative safety of his or her automobile. In this way, the officer can simply "drive by" the monitored location without having to physically enter the premises. One drive-by system even provides a means for issuing an electronic "callout" signal to the monitored individual, so that he or she knows the officer is outside, and that the monitored individual must thus step outside so that the monitored individual can be seen by the officer. See, e.g., U.S. Pat. No. 4,924,211, issued to Davies et al. Unfortunately, requiring the monitored individual to always step outside of his premises may preclude the monitoring officer from discovering some necessary information needed to properly ascertain if the individual is in full compliance with the mandated restrictions of the house arrest. Hence, what is needed is an EHAM system that allows the officer to enter the premises of the monitored individual, and still provides some measure of protection while there.

SUMMARY OF THE INVENTION

The present invention advantageously provides an EHAM system that addresses the above and other needs. In accordance with one aspect of the invention, a house arrest monitoring system allows a monitoring officer, e.g., a probation or parole officer, charged with the responsibility of making periodic and/or random physical checks with individuals whose presence at specific locations is being electronically monitored (hereafter the "offender"), to immediately and silently report to a central monitoring location that backup help or assistance is needed at the monitoring location.

One embodiment of the electronic house arrest system of the present invention, like active EHAM systems of the prior art, includes a field monitoring unit (FMU), or equivalent, installed at specific monitoring locations. A monitored individual, i.e., the offender, wears an electronic tag that periodically transmits a unique identifying signal over a short range. If the offender is within range of the FMU, the identifying signal is received by a receiver within the FMU, and logged or stored within memory circuits of the FMU, indicating the presence of the offender at the specific location of the FMU at the time the signal is received. Periodically, or randomly, telecommunicative contact is established between the FMU and a computer at a central monitoring location, and the "presence data" stored in the FMU, i.e., that data indicating when the identifying signal is received, is downloaded to the central computer, along with FMU-identifying data, indicating the specific FMU —and hence the specific address or location of the FMU— from which the presence data is obtained. From this downloaded data, the computer is able to generate reports and other data indicating whether the offender is in compliance with the particular house arrest restrictions that have been imposed.

Unlike EHAM systems of the prior art, however, the present invention includes a small pocket transmitter that is carried by the monitoring officer. When the monitoring officer goes into the field to physically visit with a particular offender, this pocket transmitter is always at the officer's fingertips. If the officer senses danger or otherwise needs backup assistance at or near a monitored location, the officer silently activates a transmit button or switch on the pocket transmitter, which action causes a universal "needs assistance" signal to be transmitted. The "needs assistance" signal, which may also be referred to hereinafter as an "officer assist" signal, is received by the FMU at the monitored location. The processing circuits of the FMU react to receipt of the "needs assistance" signal by immediately establishing telecommunicative contact with the computer at the central monitoring location, and sending to the computer an indication that the "needs assistance" signal has been received through a particular FMU. The computer is able to identify the particular FMU through FMU-identifying data that is also sent to the computer once telecommunicative contact is established between the FMU and the computer. The central computer, upon receipt of the "needs assistance" signal and the FMU-identifying data, looks up the address assigned to the identified FMU, and immediately takes appropriate action to cause backup assistance to be dispatched to the identified address.

Another embodiment of the invention includes a special portable receiver carried in the automobile of the officer. The receiver is able to detect any identifying signal transmitted by the offender tag when the officer drives by the location where the offender is supposed to be. If the officer needs to inspect or visit the offender, the automobile is parked near the residence of the offender, and the officer carries the small pocket transmitter, as described above, as such visit is made. If the officer senses danger, the officer silently activates the transmit button on the pocket transmitter, causing the "officer assist" signal to be transmitted. The officer assist signal is received at the portable receiver carried in the officer's automobile. The portable receiver is configured, upon receipt of the officer assist signal, to alert a companion of the officer (who is waiting in the car). Alternatively, in some embodiments, the receiver responds to the officer assist signal by automatically establishing radio contact with the appropriate dispatch location, and alerting the dispatch office of the officer assist situation. This embodiment of the invention thus allows the officer some measure of protection even when the premises being visited does not include an FMU, or equivalent, installed at the offender's residence to electronically monitor the offender.

Thus, the present invention may be characterized as a portable transmitter for use with an electronic house arrest monitoring (EHAM) system or other monitoring program. Such EHAM system, like EHAM systems of the prior art, includes means for electronically monitoring the presence or absence of an offender at a prescribed location. This is done through use of an in-house monitoring unit (IMU), or equivalent, that is placed at the prescribed location. In some embodiments, as indicated above, the equivalent of the IMU may be carried in the officer's automobile. Such IMU is capable of establishing telecommunicative contact with a central monitoring station. Further, the IMU typically includes means for generating and sending an information signal to the central monitoring station through the established telecommunicative contact that identifies a particular IMU and indicates whether the presence of the offender has been detected at the prescribed location.

A portable transmitter in accordance with this embodiment of the invention includes: (1) a radio frequency (RF) oscillator that generates an RF signal; (2) modulating means for modulating the RF signal with a multiplicity of bits of information, e.g., at least 32 bits of information, a subset of these bits including a prescribed first code that identifies a need for assistance; (3) transmitting means for selectively transmitting the modulated RF signal, and (4) switch a responsive to manual activation for controlling the modulated RF signal to be transmitted by the transmitting means.

Advantageously, the transmitted modulated RF signal generated by the portable transmitter is receivable within a receiver circuit of the IMU if the portable transmitter is in the vicinity of the IMU when the modulated RF signal is transmitted. Thus, an officer carrying the portable transmitter can visit the offender at the prescribed location and manually activate the switch means if a potential need for assistance is detected. If so, such activation causes the first code to be transmitted in the modulated RF signal. If this first code is detected in the modulated RF signal that is received by the IMU receiver, the IMU receiver responds differently than the IMU receiver responds when electronically confirming the presence of the offender at the prescribed location. Specifically, the IMU receiver immediately communicates the need-for-assistance information evidenced by receipt of the first code to the central monitoring station. In this way the central monitoring station is made aware of a need for assistance at the prescribed location where the particular IMU is located.

Another embodiment of the invention may be characterized as an electronic house arrest monitoring (EHAM) system used for monitoring the presence or absence of an offender at a prescribed location remote from a central monitoring location. Such EHAM system includes, as do EHAM systems of the prior art, a tag carried by the offender. This tag includes transmitter means for generating and transmitting a first multi-bit identification (ID) signal at low power, and hence over a short range. This first ID signal includes a particular combination of bits that uniquely identifies the offender to whom the tag has been assigned.

Unlike EHAM systems of the prior art, the EHAM system in accordance with this embodiment of the invention also includes a triggerable portable transmitter carried by an officer who visits the offender at the prescribed location. This triggerable portable transmitter includes means for manually triggering the generation and transmission of a second multi-bit ID signal upon manual activation of a transmit switch. This second ID signal includes a prescribed combination of bits that identifies an "officer assist" situation, i.e., a situation wherein the officer believes back-up assistance may be needed at the prescribed location based on what the officer sees or senses at the prescribed location.

The EHAM system further includes an in-house monitoring unit (IMU), or equivalent, at the prescribed location, or carried in the officers automobile so it can be positioned near the prescribed location. Such IMU includes a receiver for receiving the first and second ID signals. The IMU additionally includes processing means for examining the received first and second ID signals to determine the particular combination of bits contained therein, and hence to determine whether the offender is at the prescribed location or whether the officer has signaled that back-up assistance may be needed. The IMU thus responds differently to receipt of the first ID signal than it does to receipt of the second ID signal.

The EHAM system also includes a central processing unit (CPU) at the central monitoring location, and means for selectively establishing telecommunicative contact between the IMU and CPU. In particular, the IMU includes means for notifying the CPU of the receipt of the second ID signal through the established telecommunicative contact, and providing the CPU with information that identifies the prescribed location at which the second ID signal was received. Upon such notification at the central monitoring location, appropriate action may then be taken to dispatch back-up assistance to the prescribed location. Hence, the officer is able to "silently" signal the central monitoring station that backup assistance may be needed at a particular location where the officer is visiting an offender.

Another embodiment of the invention may be characterized as a method of protecting an officer who is visiting offenders in the field. Such offenders are monitored with an electronic house arrest monitoring (EHAM) system of the type described above. That is, the EHAM system includes a plurality of in-house monitoring units (IMUs), or equivalent, respectively installed at or positioned near prescribed field locations, each of the IMUs being at a known field location, and each including means for electronically monitoring its respective field location for the presence or absence of the offender. Each IMU further includes means for establishing telecommunicative contact with a central monitoring station and electronically reporting the results of such monitoring. The officer protection method includes the following steps:

(1) Providing the officer with a portable transmitter. Such portable transmitter includes means for selectively generating and transmitting an electronic signal that includes a first code that identifies a need for back-up assistance. This electronic signal is receivable by an IMU that is within a few hundred feet of the portable transmitter at the time the electronic signal is generated.

(2) Triggering the transmission of the electronic signal whenever the officer perceives that back-up assistance may be needed at a particular field location where the officer is visiting. This electronic signal is then received within the IMU at that field location.

(3) Verifying the presence of the first code in the electronic signal received within the IMU.

(4) Responding to the verification in a way that is different from the electronically reporting response of the IMU when monitoring the presence or absence of the offender at the prescribed location by automatically establishing telecommunicative contact with the central monitoring station.

(5) Electronically notifying the central monitoring station through the telecommunicative contact of the identity of the particular IMU at which the first code was received.

(6) Determining the location of the officer in the field from the identity of the particular IMU where the first code was received.

(7) Dispatching back-up assistance to the determined location of the officer in the field.

It is thus a feature of the present invention to provide an EHAM system that provides the monitoring officer some measure of security or protection as he or she makes visits with offenders in the field.

It is an additional feature of the invention to provide an EHAM system that allows an officer to effectively be in continuous telecommunicative contact with backup assistance while making visits with offenders in the field, thereby allowing the officer to make such visits near or in the residence of the offender so long as a field monitoring unit, or equivalent, is located at the location where the visit is made.

It is another feature of the invention to provide such an EHAM system that does not require a team of monitoring officers to make visits with offenders in the field in order to safely check compliance with mandated restrictions. Rather, the EHAM system of the present invention facilitates a single officer making such visits. Should a dangerous situation develop, however, it is a further feature of the present invention to provide a means whereby such dangerous situation can be immediately reported by the officer to appropriate law enforcement authorities. In response, a team of law enforcement officers, e.g., police or sheriff officers from the nearest available location, can be immediately dispatched to the location where the dangerous situation has developed.

BRIEF DESCRIPTION OF THE DRAWINGS

The above and other aspects, features and advantages of the present invention will be more apparent from the following more particular description thereof, presented in conjunction with the following drawings wherein.

Like reference numerals are used to represent like elements in the various figures and the accompanying description that follows.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
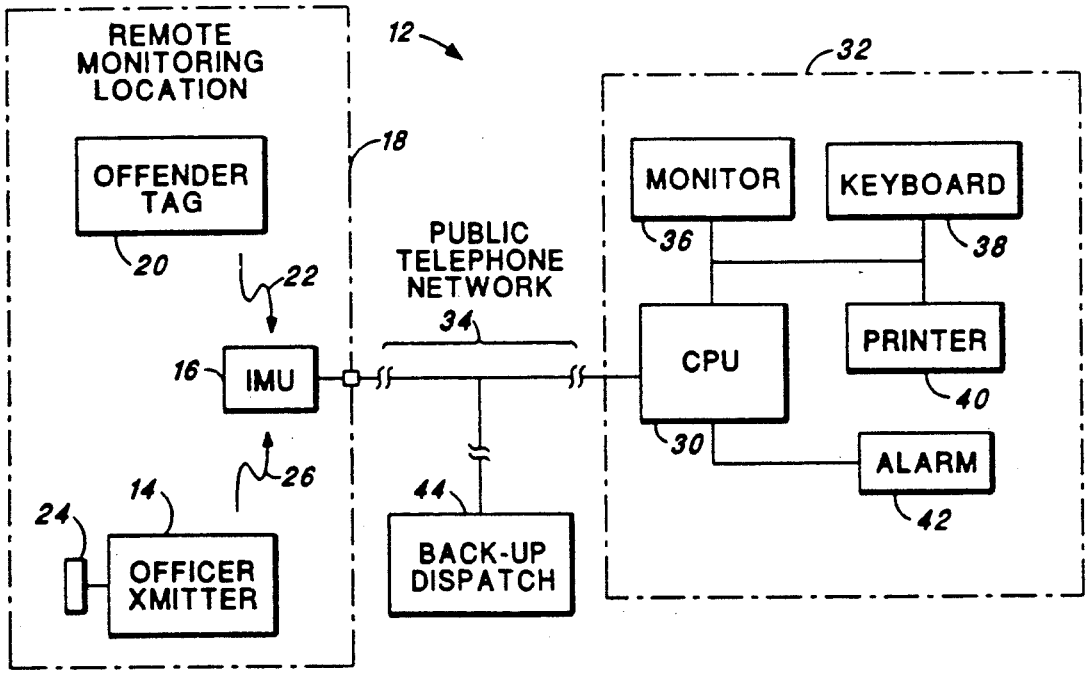
FIG. 1 is a block diagram of an EHAM system, that includes a portable officer transmitter.

Referring first to FIG. 1, there is shown a block diagram of an electronic house arrest monitoring (EHAM) system 12 made in accordance with the present invention. The EHAM system 12 includes a portable officer transmitter 14, and an in-house monitoring unit (IMU) 16, or equivalent. The IMU 16 is located at a particular remote monitoring location 18. Typically, the remote monitoring location 18 comprises a house whereat the individual to be monitored, the "offender", resides. However, any location, such as a place of work or school, may also be utilized as a remote monitoring location. Further, although the description presented below is for an embodiment of the invention that includes an IMU 30 installed at the remote monitoring location 18, it is to be understood that the invention also has applicability to other embodiments, such as where the equivalent of the IMU is carried in an automobile that drives by the remote monitoring location to determine if the offender is there.

The offender is fitted with an offender tag 20. Typically, the tag 20 is fitted around the ankle or wrist of the offender with a strap or band that cannot be removed. Any attempt to cut or remove the strap, i.e., to remove the tag from the offender, is detected by the circuits within the tag, as described, e.g., in the Pauley et al. or Watson patents cited above. Any such attempt to remove the tag from the offender is treated as a "tamper event", and the occurrence of any tamper event is immediately signaled to the IMU 16.

For active EHAM systems, as described above, the tag 20 periodically, e.g., every 10–120 seconds, transmits an identification (ID) signal 22. The ID signal 22 transmitted from the tag is symbolically represented in FIG. 1 as a wavy arrow 22. The ID signal is typically a digitally modulated radio frequency (RF) signal, containing a multiplicity of bits. This modulated RF signal is transmitted from the tag 20 at low power, and hence over a short range. Typically, the boundaries of the monitoring location 18 are determined by the range of the ID signal. Thus, whenever the tag is sufficiently distant from the IMU 16 so that the ID signal is not received, i.e., is out of range, then the offender is not considered as being at the house arrest location.

Some of the bits of the ID signal 22 are used as an "ID code" to uniquely identify a particular tag, and hence a particular offender to whom the tag has been assigned. Others of the bits within the modulated RF signal may be used to indicate whether a tamper event has occurred, or to convey other information that is sensed by the tag.

In accordance with the present invention, the officer transmitter 14 also includes means for generating an ID signal 26 upon activation of a transmit switch 24. The ID signal 26 is represented symbolically in FIG. 1 as the wavy arrow 26. The ID signal 26 is designed to be the same type of signal as the ID signal 22, i.e., it is an RF signal digitally modulated with a multiplicity of bits. Some of the bits within the ID signal 26 are selected to define an "officer assist" code. That is, the ID signal 26 always contains an officer assist code. The ID signal 26 may also include, in some embodiments of the invention, additional bits that uniquely define the officer transmitter 14, and hence the officer to whom the transmitter has been assigned.

Any ID signal within range of the IMU 16 is received within a receiver of the IMU 16. That is, either the ID signal 22 and/or the ID signal 26 is received within the IMU 16. The IMU 16, as explained more fully below, includes means for examining the received ID signal 22 or 26 in order to determine the presence of a particular ID or officer assist code. It also includes a memory for storing data that indicates at what time a particular ID code, officer assist code, or other code, was first received. This stored data thus provides a history indicating at what time a particular ID or officer assist code, or other type of code, was first received or generated by the IMU, thereby providing data that shows the presence or absence of the offender at the monitoring location, as well as whether and when any officer assist signals were triggered.

The IMU 16 is in selective telecommunicative contact with a monitoring computer, referred to herein as a central processing unit (CPU) 30, at a central monitoring location 32. Such telecommunicative contact is typically established via a public telephone network 34. However, any type of telecommunicative contact may be used between the IMU 16 and the CPU 30, including cellular systems, satellite communication systems, cable TV systems, and the like.

The CPU 30 is maintained by a particular agency, e.g., Probation Control, charged with the responsibility of monitoring the offender for compliance with a particular house arrest schedule. The CPU 30 advantageously monitors numerous field locations, i.e., it makes telecommunicative contact with a large number of IMUs at various remote monitoring locations.

For the EHAM system of the present invention, the CPU 30 may be realized using a 286/386/486 AT personal computer system of the type available from numerous vendors. Such CPU includes sufficient memory for storing information concerning the ID numbers and locations of all the IMUs that are monitored using such CPU. The CPU 30 also typically includes a monitor 36, a keyboard 38 and a printer 40 to facilitate entering and retrieving information, such as address information and reports, that is entered into or generated by the EHAM system. Further, in accordance with the present invention, the CPU 30 may be coupled to a suitable alarm 42, which alarm may provide an audio and/or visual indication that an "officer assist" code has been received from a given IMU. Such alarm 42 may be realized using the components internal to the CPU, or may be a separate device that is attached to the CPU.

Typically, the telecommunicative contact between the CPU 30 and the IMU 16 is established as controlled by the CPU 30. That is, the CPU 30 may be programmed to regularly poll the various IMUs 16 for which it is responsible through the established telecommunicative link, i.e., through the public telephone network. However, for the EHAM system of the present invention, as well as for any EHAM system that is capable of detecting a tamper event at the remote monitoring location, the IMU 16 may also initiate contact with the CPU 30 whenever there is a need to do so, e.g., when a report is due from the IMU 30, or when a tamper event or officer assist code has been received by the IMU. In one embodiment of the invention, the IMU 30 reports to the CPU whenever an officer assist code is received, or whenever there is a change in the offender code, i.e., whenever the offender enters or leaves the monitored location 18.

When the CPU receives information from a particular IMU indicating that an officer assist code has been received by the IMU, then appropriate action is taken by the CPU 30, or by personnel at the central monitoring location 32 who are informed of such information (e.g., through the alarm 42), to dispatch appropriate assistance to the remote monitoring location 18 from which the information was received. The address of the remote monitoring location is readily determined by using a look-up table, stored in the memory of the CPU, that identifies the particular address of each IMU. Typically, such dispatch is made by notifying an appropriate law enforcement agency (or other source of back-up assistance) that such assistance is needed. Such back-up assistance is represented in the block diagram of FIG. 1 as a "back-up dispatch" block 44. Contact with the back-up dispatch assistance 44 may be made via the public telephone network 34 or other established communication link.

Figure 2:
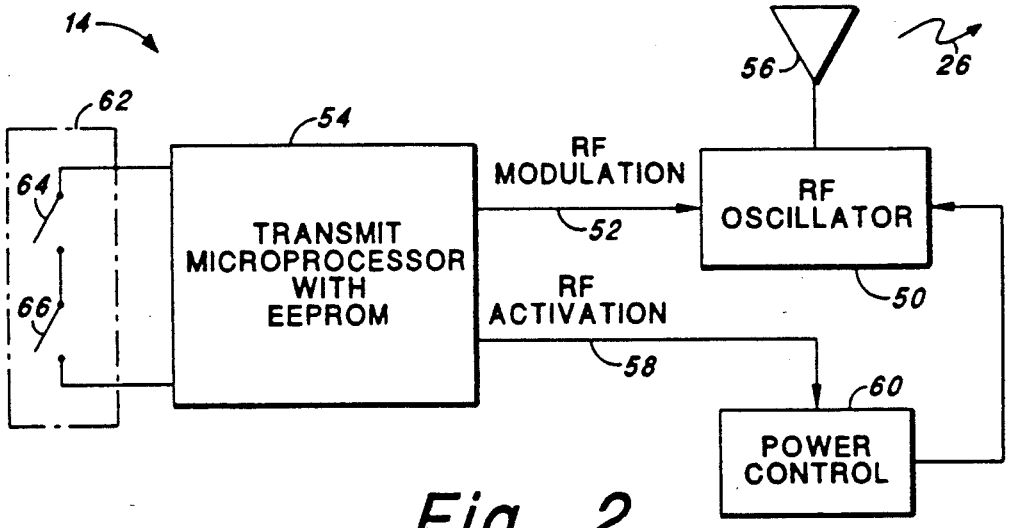
FIG. 2 is a block diagram of the officer transmitter of the EHAM system of FIG. 1.

Referring next to FIG. 2, a block diagram of the officer transmitter 14 of the EHAM system 12 (FIG. 1) is shown. The transmitter 14 includes an RF oscillator 50 that generates an RF signal modulated by an RF modulation signal 52. The RF modulation signal is generated by a microprocessor 54, which microprocessor includes an electronic erasable programmable read only memory (EEPROM). Data held in the EEPROM modulates the RF signal (using an appropriate modulation scheme). The modulated RF signal from the RF oscillator 50 is coupled to an antenna 56. The signal propagates from the antenna as the ID signal 26. The transmit microprocessor 54 is selectively activated by an activation switch 62. Upon activation, the microprocessor 54 generates an RF activation signal 58 that turns on power control circuitry 60. The power control circuitry 60 includes a suitable source of stored electrical energy, such as a battery, that is applied to the RF oscillator upon receipt of the RF activation signal 58.

In the preferred embodiment, the data held in EEPROM 58 includes an assigned sequence of bits that represents an "officer assist" code. Advantageously, such officer assist code may be the same for all transmitters 14 that are manufactured, thereby facilitating the manufacture and testing of the transmitter 14. In this way, the transmitter ID signal 26 generated by the transmitter 14 always contains the "officer assist" code. When received at the central monitoring location 32, such officer assist code 26, along with information that identifies the location of the IMU 16 through which the officer assist code 26 was received, thus identifies that assistance is needed at that particular IMU location.

In some embodiments, the EEPROM 58 of the transmitter 14 may be further programmed with an officer ID code that uniquely identifies a particular officer to whom the transmitter is assigned. This use of the EEPROM within the transmit microprocessor 54 facilitates the addition and use of such an officer ID code. Thus, in such embodiments, when the transmitter ID signal 26 is generated and transmitted, it includes the officer assist code and the officer ID code, thereby identifying not only the fact that assistance is needed, but also the particular officer who needs the assistance. The location at which the assistance is needed is determined from the identity of the IMU 16 through which the officer assist code is received.

As described above, the transmitter 14 includes suitable power control circuitry 60 that provides operating power to the RF oscillator 50 upon activation of the switch 62. This power control circuitry includes a power source, such as a conventional lithium battery. Most of the time, the power control circuitry 60 does not apply power to the RF oscillator 50, and thus no transmitter ID signal 26 is generated. Only when the switch 62 is closed is power applied to the RF oscillator 50 so as to cause the ID signal 26 to be generated. It is noted that the microprocessor 54, which is preferably a CMOS microprocessor of a type commercially available from numerous vendors, is powered all the time. However, unless the activation switch 62 is turned on, the microprocessor 54 is in an inactive state that consumes minimal power.

In order to close the activation switch 62, two push button switches 64 and 66, connected in series, must both be depressed. This is done to prevent accidental triggering of the transmitter 14. Any simultaneous closure of the two switches 64 and 66 causes the RF oscillator 50 to generate the ID signal 26.

In a preferred embodiment the microprocessor 54 and power control circuitry 60 are configured so that a burst of eight ID signals are transmitted upon closure of both switches 64 and 66 (i.e., upon closure of activation switch 62). This burst of eight ID signals represents the maximum RF output power that is legally allowed in the United States under regulations and laws promulgated by the Federal Communications Commission (FCC). Similar laws and restrictions exist in foreign countries. Any number of bursts of the modulated RF output signal that is within legal limits, e.g. 4 bursts, could be programmed into the microprocessor 54 for transmission upon closure of the activation switch 62. Generally, it is desirable that more than a single burst be transmitted to ensure that at least one burst will be received at the IMU 16. Both switches 64 and 66 must be released and simultaneously depressed in order to trigger the transmission of another burst of RF modulated signals.

Figure 3:
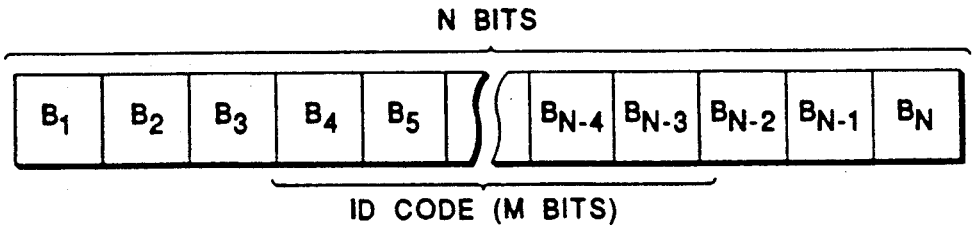
FIG. 3 is a diagrammatic representation of the identification signal, or ID signal, that is transmitted from the officer transmitter.

FIG. 3 diagrammatically represents the ID signal 26 that is transmitted from the officer transmitter 14. This signal is made up of a sequence of a plurality of N bits, $B_1$, $B_2$, $B_3$, . . . $B_N$. This sequence of bits typically includes a start bit sequence, a stop bit sequence, and appropriate error correcting bits (which may be as simple as a parity bit or bits). Most importantly, the sequence of bits includes an ID code of M bits, where M is less than N. This ID code of M bits, for the ID signal 26, comprises a unique sequence of bits that identifies an "officer assist" situation.

In the preferred embodiment, the frequency of the RF signal generated by the oscillator 50 falls within the range of 902–928 Mhz. This RF signal is amplitude modulated (AM) by the data stored in the EEPROM included within the transmit microprocessor 54. This data is 32–64 bits long (4–8 eight bit words), i.e., N=32–64. The ID code portion is typically 24 bits long (three eight bit words), i.e., M=24. However, it is to be understood that these numbers, bit lengths, and modulation scheme are only representative, and that other frequencies, bit lengths, and modulation schemes could be used.

Figure 4:
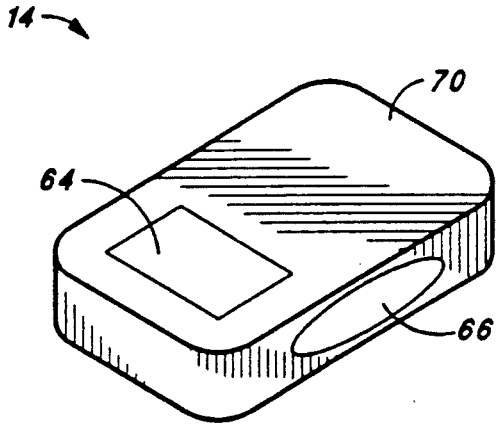
FIG. 4 is a perspective view of the officer transmitter housing.

Referring next to FIG. 4, a perspective view of a housing 70 wherein the officer transmitter 14 is housed is illustrated. The housing 70 is small, having dimensions of approximately 0.6 by 2.5 by 1.5 inches. It is designed to be readily carried in a pocket or purse of the officer without being noticeable. The antenna 56 may be inside of the housing 70. Included in the housing 70 is a water resistant battery compartment, accessed by means of a sliding (or otherwise removable) panel, wherein the battery or batteries of the power control circuitry 60 may be detachably placed. The push button 64 is preferably set on the top of the housing near one end. The push button 66 is preferably set along one side of the housing 70. Both buttons 64 and 66 must be depressed at the same time in order to trigger the transmitter. This arrangement thus prevents accidental triggering of the transmitter.

Figure 5:
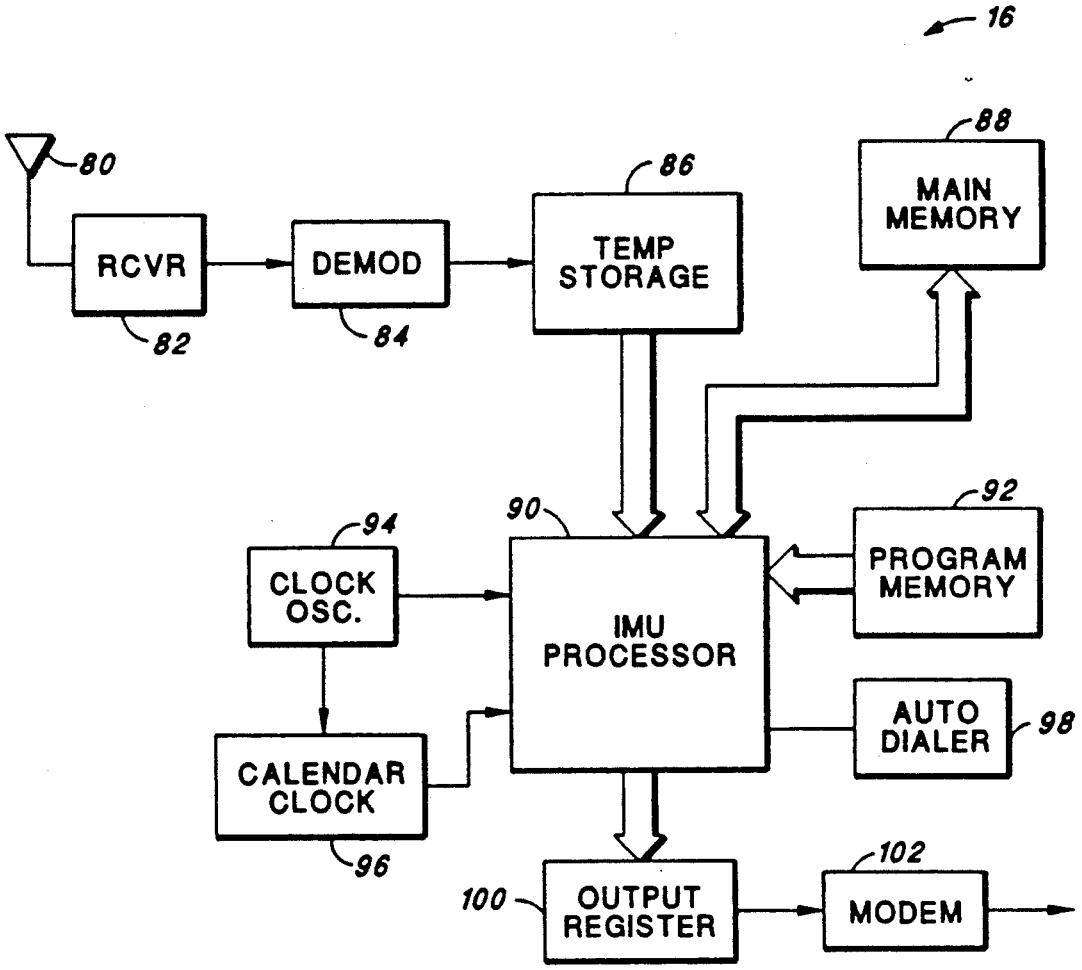
FIG. 5 is a simplified block diagram of the in-house monitoring unit, or IMU, used with the system of FIG. 1.

The design of the IMU 16 is illustrated in the functional block diagram of FIG. 5. Except for recognition of the officer assist code, and responding thereto in an appropriate manner, the IMU 16 may be essentially the same as the IMU used with a conventional EHAM system of the type described in the Watson or Pauley et al. patents previously referenced. Basically, this hardware allows a modulated RF signal, whether from the offender tag 20 or the officer transmitter 14, to be received and demodulated. The informational content of the received signal, i.e., the demodulated bit sequence, is then processed so as to check its contents for the presence of any action codes. An "action code" is any code that requires action on the part of the IMU. For example, if an "officer assist" code is present, then the IMU includes the capability to immediately establish telecommunicative contact with the CPU at the central monitoring location in order to pass the needed information to the CPU concerning the receipt of such code. If a code other than an action code is present, then such code may still be logged or stored in the memory of the IMU, along with the time of its receipt, so that such can be later transferred or downloaded to the CPU.

As seen in the block diagram of FIG. 5, the IMU 16 includes an antenna 80 coupled to a receiver circuit 82. The receiver circuit 82 is connected to a demodulator circuit 84. The demodulator circuit 84 presents the demodulated data bits to a temporary storage register 86. While held in the temporary storage register 86, the bits are processed by the IMU processor 90. This processor 90 (as Well as the processor 54 of the transmitter 14) may be or may include a conventional microprocessor, such as the 68HC05, manufactured by Motorola.

The processor 90 processes the bits held in the temporary storage register 86 as controlled by an operating program held in a program memory 92. Such processing is aimed at verifying that a proper sequence of bits has been received, and to determine if any valid ID codes, or officer assist codes, or other informational codes, are present in the bit sequence. Such verifying is accomplished, in part, by comparing the bits received with known sequences of bits, stored in a main memory 88, that may be received. If a valid code is received, it is date stamped. That is, the IMU processor 90 includes a suitable clock oscillator 94 and calendar clock 96 that keeps track of the current date and time. When a valid code is noted in the temporary storage 86, the code is expanded to include a code representative of the valid code and of the date and time of receipt of the valid code. If the code is an action code, then the processor 90 immediately transfers the expanded code, further expanded to include information that identifies the particular IMU 16, to an output register 100. Further, the receipt of an action code activates an auto dialer 98, or equivalent, that establishes the appropriate telecommunicative contact with the CPU 30 at the central monitoring location 32. Once such contact is established, the fully expanded output code is transferred to the CPU using conventional telecommunicative communication data transfer techniques, e.g, through use of a modem 102. In a preferred embodiment, the data is transferred between the IMU 16 and the CPU 30 at a rate of 300 baud.

As will be appreciated by those skilled in the art, many of the elements of the IMU 16 shown in FIG. 5 are functional, and as such, many of these elements may be realized in practice through appropriate software control of the microprocessor circuit used within the IMU 16. Further, many of the elements shown in FIG. 5 are included in conventional commercially available microprocessor chips. For example, the temporary storage 86 and output register 100 may be realized using the standard registers within the microprocessor chip.

Figure 6:
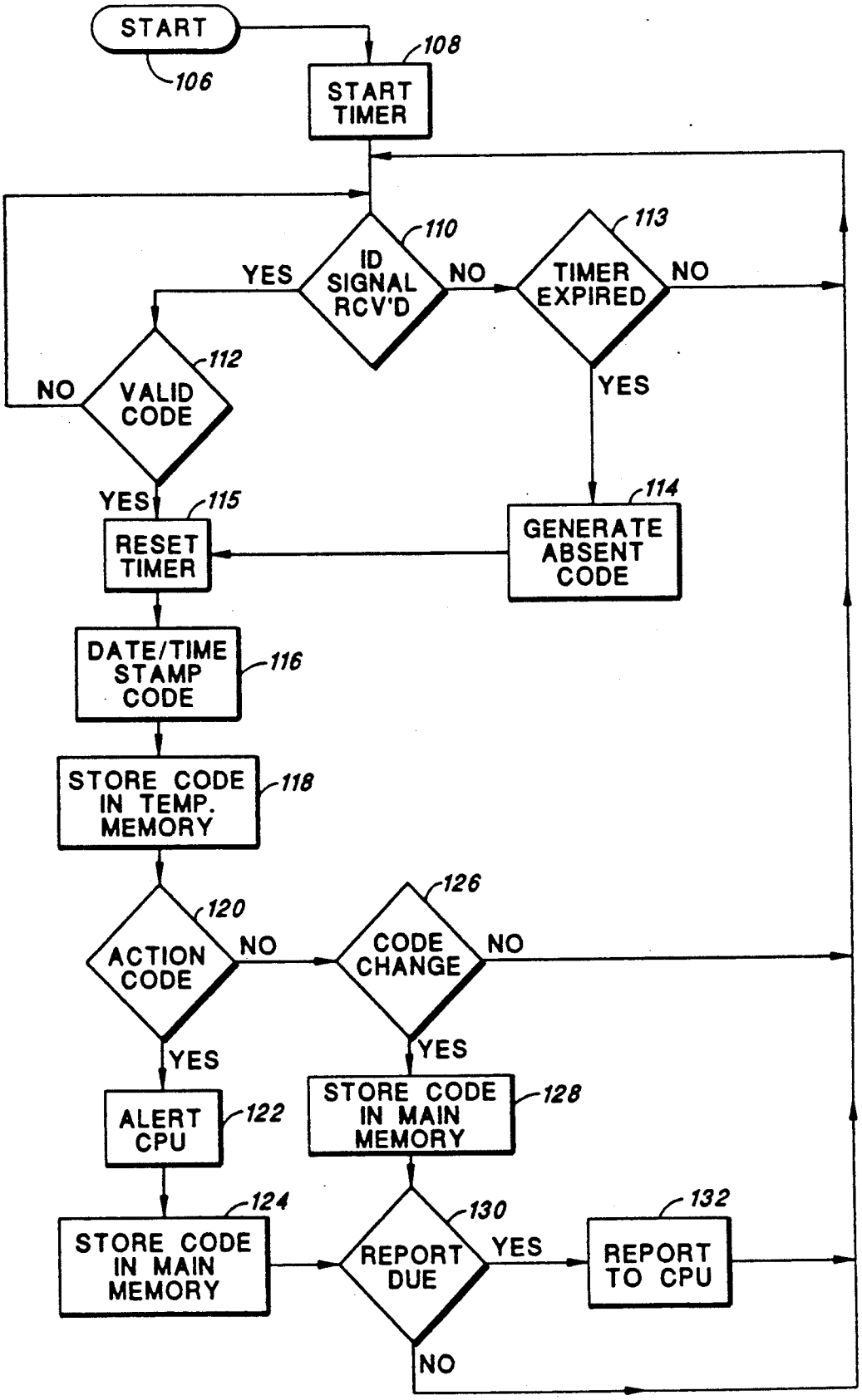
FIG. 6 is a flow chart illustrating one type of monitoring program that may be used to control the processor of the IMU.

FIG. 6 shows a flow chart illustrating one type of monitoring program that may be used to control the processor of the IMU. In the following description of the flow chart, reference is made to the individual "blocks" used therein, which blocks represent specific steps or functions of the program. Those skilled in the art can readily fashion appropriate code to realize these steps.

As a first step of the program, after it has begun (block 106), a timer is started (block 108). It is the function of this timer to define a time period, or window, during which an ID signal must be received or else an absent code will be generated. Thus, after starting the timer, a decision is next made as to whether an ID signal has been received (block 110). This decision is made in large part by looking for a proper sequence of start and stop bits in the demodulated signal that has been received. If an identification signal has been received, another decision is made (at block 112) as to whether the sequence of bits received contains a valid code, e.g., an "officer assist" code, or a valid offender ID code. If an identification signal has not been received, and if the timer has not yet expired (block 113), then the program waits until the end of the time period set by the timer to see if an ID signal is received. If the timer expires and no ID signal is received, then an absent code is generated (block 114).

Upon receipt of a valid code or the generation of another absent code, the timer is reset (block 115), or restarted, in order to define a new time period or window during which an ID signal must be received to prevent the generation of an absent code. The valid code or absent code is then expanded to include date/-time information, indicating the date and time at which the valid code was received or the absent code was generated (block 116). This expanded code is then stored in temporary memory for analysis (block 118). If the code includes an "officer assist" (OA) code, or other action code (block 120), then the CPU is alerted of such receipt (block 122). As has been indicated, such alerting involves immediately establishing telecommunicative contact with the CPU, and notifying the CPU of the particular action code received and the identity of the IMU at which it was received. The code may thereafter be stored in main memory (block 124) for later retrieval.

If the code stored in temporary memory is not an action code (block 120), then the code is compared with the previous code that was stored in the temporary memory to determine if there has been a code change (block 126). If not, then the program waits for receipt of the next ID signal (block 110). If so, i.e., if there has been a code change, then that means either the offender has left or returned from the remote monitoring location since the last code was received. As such, this changed code (which includes date and time information) is stored in main memory (block 128). Then, when a report is due (block 130), which may be everytime there is a code change, the information stored in the main memory is downloaded and reported to the CPU (block 132) so that the CPU can generate the needed reports and status information required by the monitoring personnel. Such report could indicate, e.g., when (date and time) the offender entered the remote monitoring location and when the offender left the monitoring location. The report could also indicate when (date and time) any action codes were received.

It is to be emphasized that the program illustrated in FIG. 6 is merely exemplary of one of many types of operating programs that may be used with an EHAM system. The particular program used depends on the particular monitoring application, and the needs of the agency doing the monitoring. Advantageously, the program may be readily adapted to suit the particular needs of the agency involved, as taught, e.g., in the Carroll et al patent, U.S. Pat. No. 4,952,928. The program may also be adapted as needed to best provide notice to an appropriate agency so that backup assistance may be provided to the indicated location in a timely and efficient matter.

As described above, it is thus seen that the present invention provides an EHAM system wherein the monitoring officer has some measure of security or back-up protection as he or she makes visits with offenders in the field.

As further seen from the above description, the invention allows an officer making physical contact with offenders being monitored by an EHAM system to effectively be in continuous telecommunicative contact with backup assistance, thereby allowing the officer to make such visits near or in the residence of the offender so long as an in-house monitoring unit, or equivalent, is located at the location where the visit is made.

It is also seen from the preceding description that the invention advantageously provides an EHAM system that does not require a team of monitoring officers to regularly make visits with offenders in the field in order to safely check compliance with mandated restrictions. Rather, the EHAM system of the present invention allows a single officer to make such visits. Should a dangerous situation develop, however, the present invention provides a means whereby such dangerous situation can be immediately reported by the officer to appropriate law enforcement authorities. In response to such report, a team of law enforcement officers, e.g., police or sheriff officers from the nearest available location, can be immediately dispatched to the location where the dangerous situation has developed.

While the invention herein disclosed has been described by means of specific embodiments and applications thereof, numerous modifications and variations could be made thereto by those skilled in the art without departing from the scope of the invention set forth in the claims.

What is claimed is:

1. An electronic house arrest monitoring (EHAM) system for monitoring the presence or absence of an offender at a prescribed location remote from a central monitoring location, comprising:

a tag carried by the offender, said tag having transmitter means therein for generating and transmitting a first multi-bit identification (ID) signal at low power, and hence over a short range, said first ID signal including a particular combination of bits that uniquely identifies the offender to whom the tag has been assigned;

a triggerable portable transmitter carried by an officer who visits the offender at the prescribed location, said triggerable portable transmitter including means for manually triggering the generation and transmission of a second multi-bit ID signal upon manual activation of a transmit switch, said second ID signal including a prescribed combination of bits that identifies a situation wherein the officer believes back-up assistance may be needed at the prescribed location;

an in-house monitoring unit at the prescribed location, said IMU including a receiver for receiving said first and second ID signals, and processing means for examining said received first and second ID signals and responding to said first ID signal with a first response and to said second ID signal with a second response different than said first response;

a central processing unit at the central monitoring location;

means for selectively establishing telecommunicative contact between said IMU and CPU;

said second response of said IMU including means for notifying said CPU of the receipt of said second ID signal through said established telecommunicative contact, and providing said CPU with information that identifies the prescribed location at which the second ID signal was received, whereupon appropriate action may be taken to dispatch back-up assistance to said prescribed location.

2. The EHAM system as set forth in claim 1 wherein said triggerable portable transmitter includes an activation switch that can be activated by said officer whenever the officer desires to trigger the generation and transmission of said second ID signal.

3. The EHAM system as set forth in claim 2 wherein said triggerable portable transmitter includes means for generating and transmitting said second ID signal at least n times, where n is an integer greater than one, upon activation of said activation switch.

4. The EHAM system as set forth in claim 2 wherein said activation switch comprises first and second push buttons connected in series, both of which must be simultaneously activated in order to trigger the generation and transmission of said second ID signal.

5. The EHAM system as set forth in claim 4 wherein said triggerable portable transmitter is housed in an enclosed housing that readily fits within a pocket of the clothing of said officer, whereby said transmitter may be concealed as said officer visits said prescribed location, said first push button being located on a first surface of said housing, and said second push button being located on a surface of said housing other than said first surface.

6. The EHAM system as set forth in claim 1 wherein said first and second multi-bit ID signals each comprise a radio frequency (RF) carrier signal that is modulated with at least 32 bits of information.

7. The EHAM system as set forth in claim 6 wherein said RF carrier signal of said first and second multi-bit ID signals is amplitude modulated with a sequence of 32 to 64 bits of information, said sequence of bits including a start bit sequence, a stop bit sequence, error correction bits, and ID code bits.

8. The EHAM system as set forth in claim 6 wherein the frequency of the RF carrier signal of both said first and second multi-bit ID signals is within the range of approximately 908 to 928 MHz.

9. A portable transmitter for use with an electronic house arrest monitoring (EHAM) system, said EHAM system including means for electronically monitoring the presence or absence of an offender at a prescribed location, said EHAM system including an in-house monitoring unit (IMU) at the prescribed location that is capable of establishing telecommunicative contact with a central monitoring station, said IMU further including means for communicating to said central monitoring station through said established telecommunicative contact an information signal that identifies a particular IMU and that indicates the presence or absence of the offender at the prescribed location, said portable transmitter comprising:

a radio frequency (RF) oscillator that generates and transmits an RF signal;

modulating means for modulating said RF signal with a multiplicity of bits of information, a subset of said bits including a prescribed first code that identifies a need for assistance; and a switch responsive to manual activation that when activated causes said modulated RF signal to be transmitted by said transmitting means;

said transmitted modulated RF signal being receivable within a receiver circuit of said IU if said portable transmitter is in the vicinity of said IMU, whereby an officer carrying said portable transmitter can visit the offender at said prescribed location and manually activate the switch if a potential need for assistance is detected, thereby causing said first code to be included in the modulated RF signal that is transmitted by said portable transmitter, which first code is detected in the modulated RF signal received by the IMU receiver causes said IMU receiver to respond differently than the IMU receiver responds when electronically confirming the presence of the offender at the prescribed location.

10. The portable transmitter as set forth in claim 9 wherein said switch includes first and second push-button switches connected in series, both of which must be simultaneously depressed in order to cause said modulated RF signal to be transmitted.

11. The portable transmitter as set forth in claim 9 wherein said portable transmitter includes means for transmitting said modulated RF signal a multiplicity of times upon a single activation of said switch.

12. The portable transmitter as set forth in claim 9 further including power control means responsive to said switch for selectively applying operating power to said RF oscillator.

13. The portable transmitter as set forth in claim 9 wherein the RF oscillator, modulating means, and switch are all housed in a small enclosed housing that allows the transmitter to be readily hidden as it is carried by the officer, said first and second push-button switches being accessible for activation from different sides of said housing.

14. The portable transmitter as set forth in claim 9 wherein said modulating means includes means for modulating said RF signal with at least 32 bits of information, said at least 32 bits including a start bit sequence, a stop bit sequence, error correction bits, and said prescribed first code that identifies a need for assistance.

15. The portable transmitter as set forth in claim 14 wherein said modulating means comprises a microprocessor circuit coupled to a memory circuit, said at least 32 bits of information being programmably stored in said memory circuit.

16. The portable transmitter as set forth in claim 15 wherein the frequency of said RF signal falls within the range of 908–928 MHz.

17. A method of protecting an officer who is visiting offenders in the field, said offenders being monitored with an electronic house arrest monitoring (EHAM) system, said EHAM system including a plurality of in-house monitoring units (IMUs) respectively installed at or positioned near prescribed field locations, each of said IMUs being at a known field location, and each including means for electronically monitoring its respective field location for the presence or absence of the offender, each IMU further including means for establishing telecommunicative contact with a central monitoring station and electronically reporting the results of such monitoring, said method comprising the steps of:

(a) providing said officer with a portable transmitter, said portable transmitter including means for selectively generating and transmitting an electronic signal, said electronic signal including a first code that identifies a need for back-up assistance, said electronic signal being receivable by an IMU that is within a few hundred feet of said portable transmitter at the time of said electronic signal is generated;

(b) triggering the transmission of said electronic signal whenever said officer perceives that back-up assistance may be needed at a particular field location whereat the officer is visiting, said electronic signal being received within the IMU at the location where the officer is visiting;

(c) verifying the presence of said first code in the electronic signal received within the IMU;

(d) responding to the verification performed in step (b) in a way that is different from the electronically reporting response of the IMU when monitoring the presence or absence of the offender at the prescribed location, said response to the verification performed in step (b) including automatically establishing telecommunicative contact with the central monitoring station;

(e) electronically notifying the central monitoring station through said telecommunicative contact of the identity of the particular IMU at which the first code was received and verified; and (f) determining the location of the particular IMU whereat the first code was received and dispatching back-up assistance to the determined location.

18. The method of protecting an officer as set forth in claim 17 wherein the processing of the received electronic signal within the IMU to determine the presence of said first code comprises:

checking the received electronic signal for the presence of an identification (ID) code;

if an ID code is present, verifying if said ID code is a valid first code; and modifying said ID code to include information that indicates the date and time at which the ID code was received;

said date and time information being thereafter forwarded to said central monitoring station along with the identity of the particular IMU that received the electronic signal.

19. The method of protecting an officer as set forth in claim 18 further including electronically storing the modified ID code within the IMU, and thereafter reporting the date and time information included in said stored modified ID code, as well as the identity of the particular IMU wherein the ID code is stored, to said central monitoring station through the established telecommunicative link.

* * * * *